US006322442B1

(12) United States Patent
Cordell

(10) Patent No.: US 6,322,442 B1
(45) Date of Patent: Nov. 27, 2001

(54) AIR DUCT REGISTER SYSTEM

(76) Inventor: Cecil Cordell, 4415 SE. 53rd Ct., Ocala, FL (US) 34480

( * ) Notice: Subject to any disclaimer, the term of this patent is extended or adjusted under 35 U.S.C. 154(b) by 0 days.

(21) Appl. No.: 09/746,309

(22) Filed: Dec. 21, 2000

(51) Int. Cl.[7] ..... F24F 7/00
(52) U.S. Cl. ..... 454/290; 454/325
(58) Field of Search ..... 454/290, 289, 454/309, 322, 333, 325

(56) References Cited

U.S. PATENT DOCUMENTS

| | | | | |
|---|---|---|---|---|
| 5,312,298 | * | 5/1994 | Myers | 454/290 |
| 5,344,364 | * | 9/1994 | Michlovic | 454/185 |
| 5,984,776 | * | 11/1999 | Berger | 454/290 |
| 6,033,304 | * | 3/2000 | Haynes | 454/290 |

* cited by examiner

*Primary Examiner*—Harold Joyce
*Assistant Examiner*—Derek S. Boles

(57) ABSTRACT

An air duct has a rectilinear face plate with an internal face and an external face. The face plate has a rectangular, central opening with a height and width less than the lengths of the edges to form a solid periphery of between about 1.0 and 2.0 inches around the edges of the face plate. The central opening has a series of air directing grates creating a plurality of rectangular shaped slots. A rectilinear housing has two parallel long side walls and two parallel short end walls oriented perpendicular to the internal face and have external edges coupled to the interior face of the face plate adjacent to the opening. Each end plate contains two large bores and one small bore. A pair of similarly configured rectangular flappers, slightly wider than 50 percent of the height of the opening and slightly shorter than the width of the opening, have a formed cylindrical extension rotatably received within the large bores. A control assembly has an actuator subassembly comprising a main plate in a generally semi-circular configuration with an exterior edge extending through a slot, the plate also having an outwardly extending pin rotatably received in the small bore, the plate also having an outrigger arm with a fork receiving an edge of one flapper. A follower subassembly has a link whereby rotation of the flapper coupled to the control assembly will rotate the other flapper.

4 Claims, 4 Drawing Sheets

FIG 3
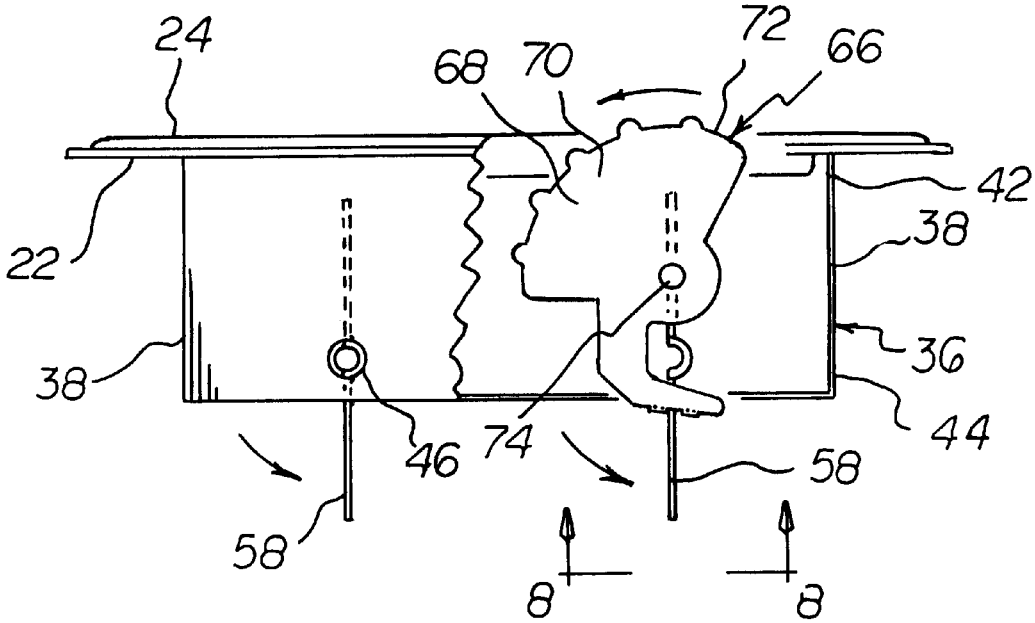
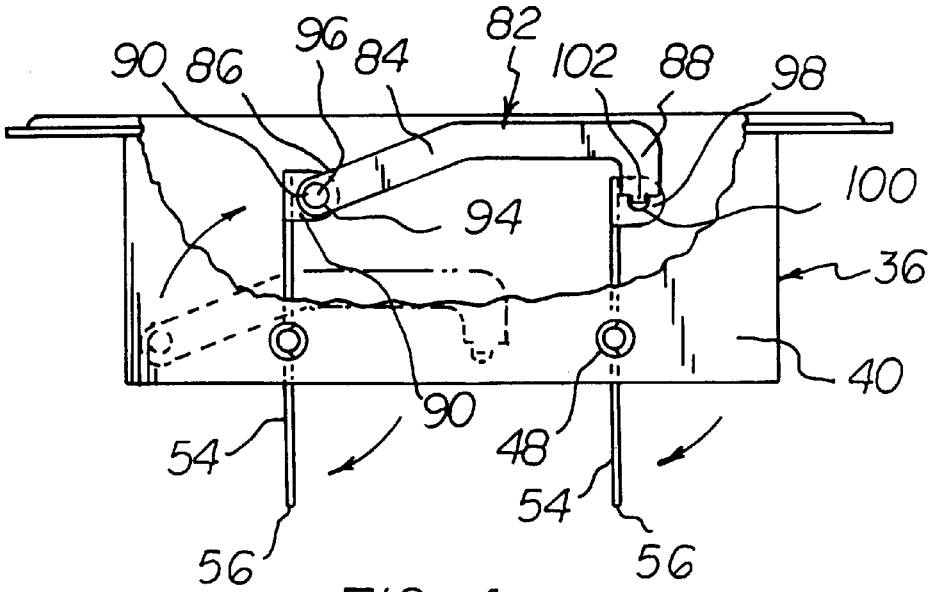
FIG 4

FIG 5
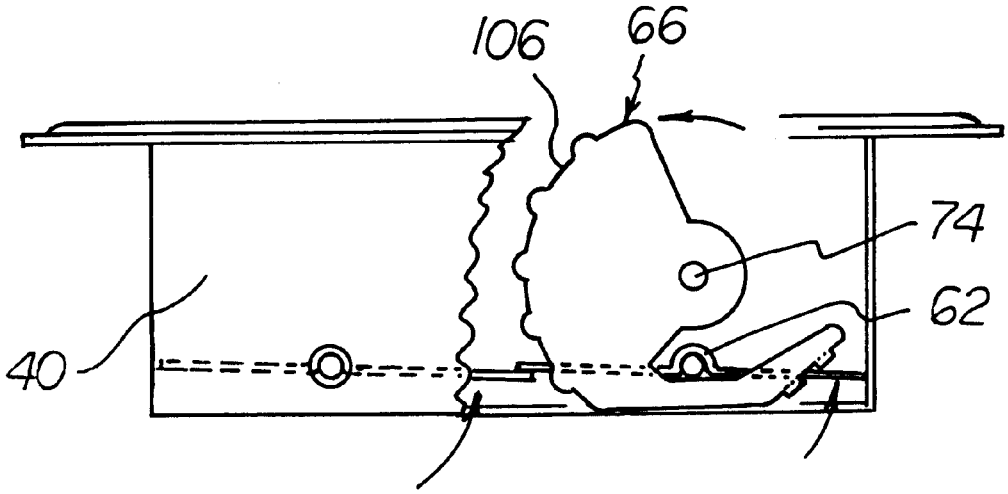
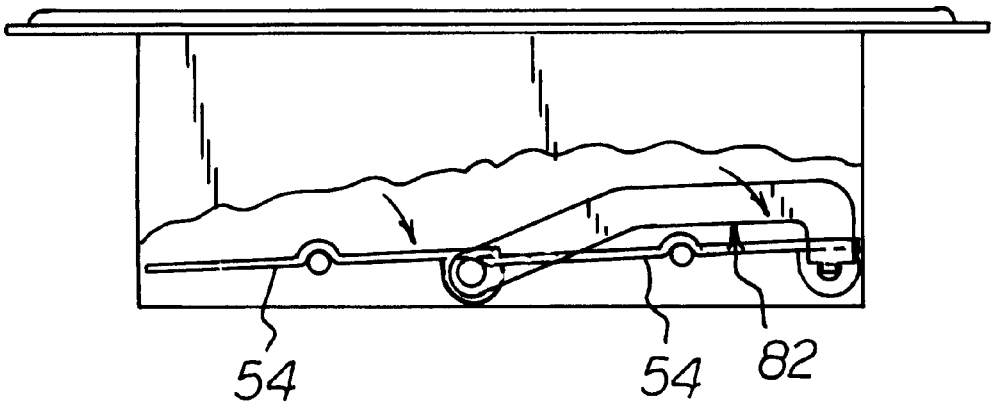
FIG 6

AIR DUCT REGISTER SYSTEM

BACKGROUND OF THE INVENTION

1. Field of the Invention

The present invention relates to an air duct register system and more particularly pertains to controlling and directing the flow of heated and cooled air into a chamber.

2. Description of the Prior Art

The use of air registers of known designs and configurations is known in the prior art. More specifically, air registers of known designs and configurations previously devised and utilized for the purpose of controlling air flows through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,938,430 to Koppang discloses air vents. U.S. Pat. No. Des. 413,665 to Hudson discloses a heating, ventilating, and air conditioning register. Lastly, U.S. Pat. No. 5,312,298 to Myers discloses a floor vent.

While these devices fulfill their respective, particular objectives and requirements, the aforementioned patents do not describe an air duct register system that allows controlling and directing the flow of heated and cooled air into a chamber.

In this respect, the an air duct register system according to the present invention substantially departs from the conventional concepts and designs of the prior art, and in doing so provides an apparatus primarily developed for the purpose of controlling and directing the flow of heated and cooled air into a chamber.

Therefore, it can be appreciated that there exists a continuing need for a new and improved an air duct register system which can be used for controlling and directing the flow of heated and cooled air into a chamber. In this regard, the present invention substantially fulfills this need.

SUMMARY OF THE INVENTION

In view of the foregoing disadvantages inherent in the known types of air registers of known designs and configurations now present in the prior art, the present invention provides an improved An air duct register system. As such, the general purpose of the present invention, which will be described subsequently in greater detail, is to provide a new and improved An air duct register system and method which has all the advantages of the prior art and none of the disadvantages.

To attain this, the present invention essentially comprises an air duct register system for controlling and directing the flow of heated and cooled air into a chamber, which comprises several components in combination. The register has a face plate which covers a duct or opening. It has a rectilinear configuration with long upper edges and lower edges and short side edges and is sized to cover the opening of an air duct into a chamber. The face plate is fabricated of rigid material, preferably a metal such as aluminum. It has an internal face and an external face. There are two fixation apertures adjacent to the side edges adapted to receive attachment screws. The face plate has a rectangular, central opening. The opening is such that the height and width is less than the lengths of the edges to form a solid periphery of between about 1.0 and 2.0 inches around the edges of the faceplate. The central opening has a series of air directing grates angled at between about 5 and 20 degrees toward the outside of the opening. This plurality of rectangular shaped slots through the face plate directs air outward at an angle, as opposed to directing the air straight out. On the internal side of the face plate is a rectilinear housing which comprises two parallel long side walls and two parallel short end walls. The walls are oriented perpendicular to the internal face and have external edges coupled to the interior face of the face plate adjacent to the opening. The end plates each contain two large bores and one small bore, the large bores are located near the external edge and equidistant from the midline of the width of the end plate. The smaller bore is located interiorly on the end plate, with its center in line with the center of one of the large bores. Within the housing is located a pair of similarly configured flappers. These have a generally rectangular configuration with two parallel long edges and two parallel short edges. The short edges are perpendicular to and connect to the ends of the long edges, forming a rectangular flapper. The flappers are slightly wider than 50 percent of the height of the opening and slightly shorter than the width of the opening. There is an arcuate ridge along the central portion of the flapper on the long axis midline. This ridge runs the entire length of the flapper and ends on each end of the flapper with a formed cylindrical extension. This extension is then rotatably received within the large bores of the housing, which allows the flapper to pivot about this axis. A control assembly which has an actuator subassembly, activates and controls the flappers. The actuator subassembly comprises a main plate in a generally semi-circular configuration. It has an exterior edge configured with ridges and indentations bent to provide a gripping surface. The main plate extends through a slot for control by a user. The plate also has an outwardly extending pin rotatably received in the small bore, allowing the main plate to pivot. The plate also has an outrigger arm with a fork which attaches to an edge of one of the flappers. The plate and arm are configured to allow the rotation about a course of travel of between 0 and 90 degrees for opening and closing the flappers. The control assembly also has a follower subassembly which comprises a link which has a proximal end and distal end. It is located adjacent to and parallel with the end plate remote from the actuator sub assembly. The proximal end is generally rounded with a hole. A flapper tab, which has a hole in it, is aligned with the hole at the proximal end and secured with a rivet through the two holes, forming a connection. The distal end of the follower subassembly has a hook-like extension on the link which extends through the hole on the other flapper tab. This allows for the rotation of the flapper coupled to the control assembly to rotate the other flapper as well.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved an air duct register system which has all of the advantages of the prior art air registers of known designs and configurations and none of the disadvantages.

It is another object of the present invention to provide a new and improved an air duct register system which may be easily and efficiently manufactured and marketed.

It is further object of the present invention to provide a new and improved an air duct register system which is of durable and reliable constructions.

An even further object of the present invention is to provide a new and improved an air duct register system which is susceptible of a low cost of manufacture with regard to both materials and labor, and which accordingly is then susceptible of low prices of sale to the consuming public, thereby making such an air duct register system economically available to the buying public.

Even still another object of the present invention is to provide a An air duct register system for controlling and directing the flow of heated and cooled air into a chamber.

Lastly, it is an object of the present invention to provide a new and improved air duct comprising a face plate having a rectilinear configuration with an internal face and an external face. The face plate has a rectangular, central opening with a height and a width less than the lengths of the edges to form a solid periphery of between about 1.0 and 2.0 inches around the edges of the faceplate. The central opening has a series of air directing grates such that there are created a plurality of rectangular shaped slots. A rectilinear housing comprises two parallel long side walls and two parallel short end walls, the walls being oriented perpendicular to the internal face, with the walls having external edges coupled to the interior face of the face plate adjacent to the opening and each of the end plates contain two large bores and one small bore. Within the housing are a pair of similarly configured flappers having a generally rectangular configuration. The flappers are slightly wider than 50 percent of the height of the opening and slightly shorter than the width of the opening and having a formed cylindrical extension rotatably received within the large bores of the housing. A control assembly, which controls the flappers, has an actuator subassembly. This comprises a main plate in a generally semi-circular configuration with an exterior edge extending through a slot. The plate also has an outwardly extending pin rotatably received in the small bore to allow rotation of the flappers. The plate also has an outrigger arm with a fork receiving an edge of one flapper. The control assembly also has a follower subassembly comprising a link whereby rotation of the flapper coupled to the control assembly will rotate the other flapper.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side elevation taken along line 3—3 of FIG. 2 above.

FIG. 4 is a side elevation taken along line 4—4 of FIG. 2 above.

FIG. 5 is a side elevation, with a cutaway, taken along line 3—3 of FIG. 2 above, showing the control assembly, actuator subassembly in place.

FIG. 6 is a cutaway elevation showing the view taken along line 4—4 of FIG. 2 above.

The same reference numerals refer to the same parts throughout the various Figures.

DESCRIPTION OF THE PREFERRED EMBODIMENT

Figure 1:
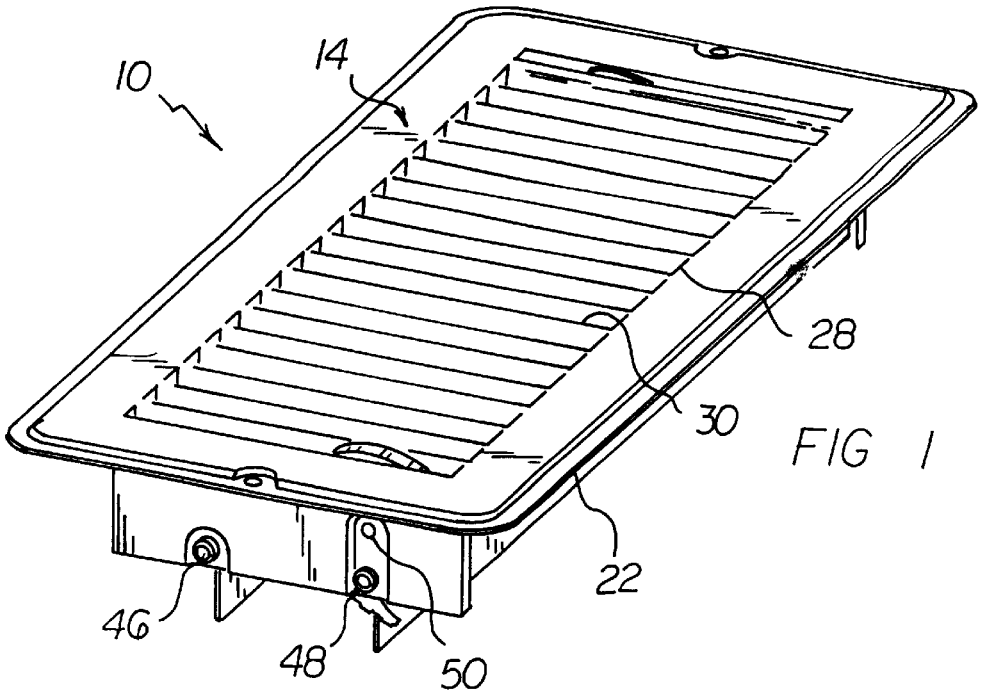
FIG. 1 is a perspective overview of the air duct register system.
Figure 2:
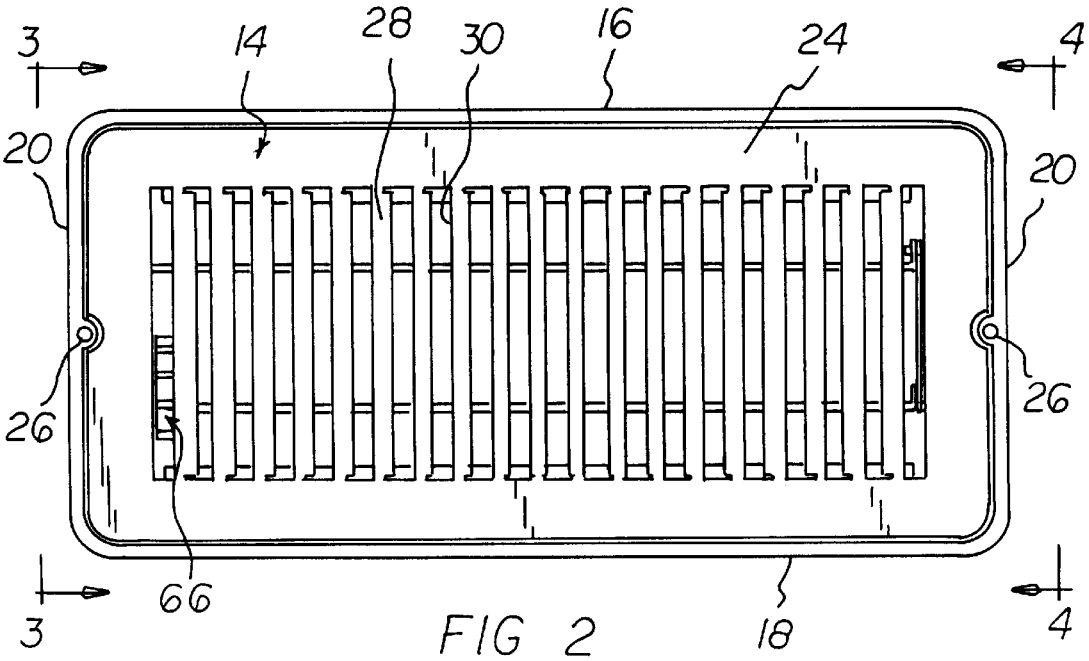
FIG. 2 is an overview of the air duct register system.
Figure 7:
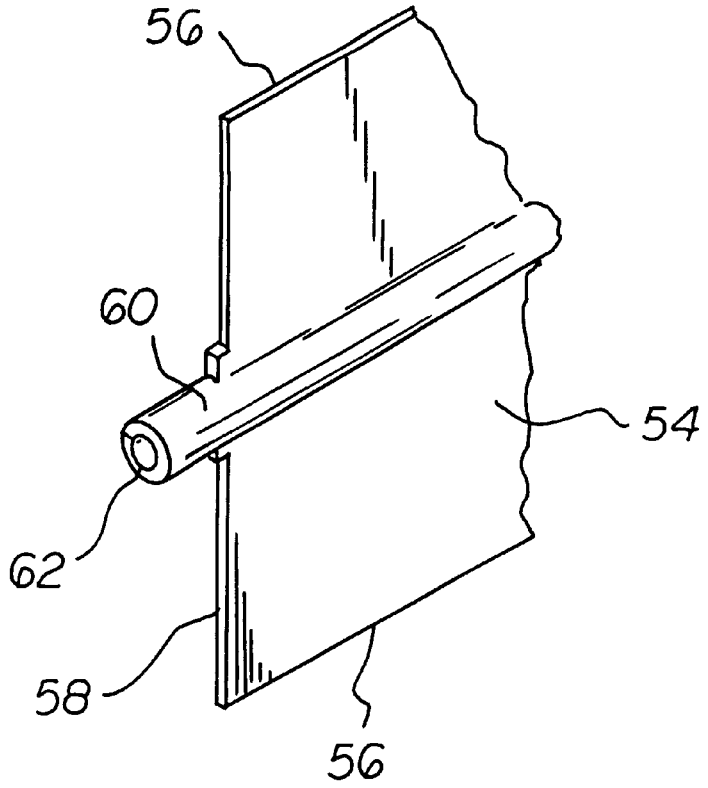
FIG. 7 is a perspective of the flapper cylindrical end of the air duct register system.
Figure 8:
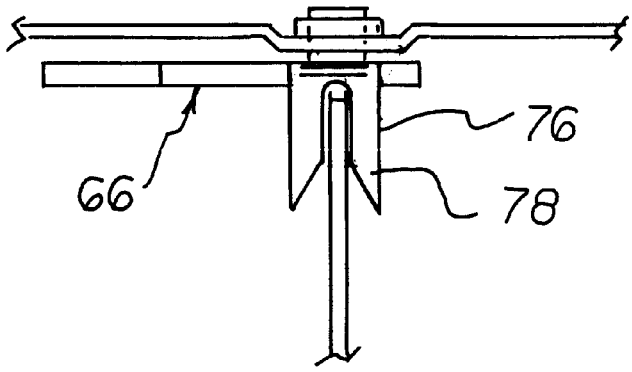
FIG. 8 is an overview of the follower subassembly and the flapper of the air duct register system.

With reference now to the drawings, and in particular to FIG. 1 thereof, the preferred embodiment of the new and improved An air duct register system embodying the principles and concepts of the present invention and generally designated by the reference numeral 10 will be described.

The present invention, the An air duct register system 10 is comprised of a plurality of components. Such components in their broadest context include a face plate, a rectilinear housing, a pair of flappers, a control assembly and a follower subassembly. Such components are individually configured and correlated with respect to each other so as to attain the desired objective. The air duct register system 10 functions for controlling and directing the flow of heated and cooled air into a room or other chamber. It comprises several components in combination. The register has a face plate 14 which covers a duct or opening. It has a rectilinear configuration with long upper edges 16 and lower edges 18 and short side edges 20 and is sized to cover the opening of an air duct into a chamber. The face plate is fabricated of rigid material, preferably a metal such as aluminum. It has an internal face 22 and an external face 24. There are two fixation apertures 26 adjacent to the side edges adapted to receive attachment screws.

The face plate has a rectangular, central opening 28. The opening is such that the height and width is less than the lengths of the edges to form a solid periphery of between about 1.0 and 2.0 inches around the edges of the faceplate. The central opening has a series of air directing grates 30 angled at between about 5 and 20 degrees toward the outside of the opening. This plurality of rectangular shaped slots 32 through the face plate directs air outward at an angle, as opposed to directing the air straight out.

On the internal side of the face plate is a rectilinear housing 36 which comprises two parallel long side walls 38 and two parallel short end walls 40. The walls are oriented perpendicular to the internal face and have external edges 42 coupled to the interior face of the face plate adjacent to the opening. The internal edges 44 are spaced interiorly. The end plates each contain two large bores 46, 48 and one small bore 50. The large bores are located near the external edge and equidistant from the midline of the width of the end plate. The smaller bore is located interiorly on the end plate, with its center in line with the center of one of the large bores.

Within the housing is located a pair of similarly configured flappers 54. These have a generally rectangular configuration with two parallel long edges 56 and two parallel short edges 58. The short edges are perpendicular to and connect to the ends of the long edges, forming a rectangular flapper. The flappers are slightly wider than 50 percent of the height of the opening and slightly shorter than the width of the opening. There is an arcuate ridge 60 along the central portion of the flapper on the long axis midline. This ridge runs the entire length of the flapper and ends on each end of the flapper with a formed cylindrical extension 62. This extension is then rotatably received within the large bores of the housing, which allows the flapper to pivot about this axis.

A control assembly 66 which has an actuator subassembly 68, activates and controls the flappers. The actuator subassembly comprises a main plate 70 in a generally semi-circular configuration. It has an exterior edge 72 configured with ridges and indentations bent to provide a gripping surface. The main plate extends through a slot for control by a user. The plate has an outwardly extending pin 74 rotatably received in the small bore, allowing the main plate to pivot. The plate also has an outrigger arm 76 with a fork 78 which attaches to an edge of one of the flappers. The plate and arm are configured to allow the rotation about a course of travel of between 0 and 90 degrees for opening and closing the flappers.

The control assembly also has a follower subassembly 82 which comprises a link 84 which has a proximal end 86 and distal end 88. It is located adjacent to and parallel with the end plate remote from the actuator subassembly. The proximal end is generally rounded with a hole 90. A flapper tab 92 which has a hole 94 in it, is aligned with the hole at the proximal end and secured with a rivet 96 through the two holes, forming a connection. The distal end of the follower subassembly has a flapper tab 98, with a hole 100 and a hook-like extension 102 on the link which extends through the hole on the other flapper tab. This allows for the rotation of the flapper coupled to the control assembly to rotate the other flapper as well.

In the primary embodiment of FIGS. 1–4, the exterior edge of the main plate 70 extends for about 90 degrees to allow for a rotation of the flapper of about 90 degrees between a fully closed orientation to a fully opened orientation as shown in FIGS. 3 and 4. In the alternate embodiment, the exterior edge 106 extends for about 180 degrees for a flapper rotation of 180 degrees. In addition, the plate has an undercut region to preclude interference with the adjacent cylindrical extension 62 when rotating fully.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An air duct register system for controlling and directing the flow of heated and cooled air into a chamber, comprising in combination;

a face plate having a rectilinear configuration with long upper edges and lower edges and short side edges sized to cover the opening of an air duct into a chamber, the face plate being fabricated of rigid material, preferably a metal, with an internal face and an external face, the face plate having two fixation apertures adjacent to the side edges adapted to receive attachment screws, the face plate having a rectangular, central opening with a height and a width less than the lengths of the edges to form a solid periphery of between about 1.0 and 2.0 inches around the edges of the faceplate, the central opening having a series of air directing grates angled at between about 5 and 20 degrees toward the outside of the opening such that there are created a plurality of rectangular shaped slots through the face plate;

a rectilinear housing comprising two parallel long side walls and two parallel short end walls, the walls being oriented perpendicular to the internal face, with the walls having external edges coupled to the interior face of the face plate adjacent to the opening and internal edges spaced interiorly thereof, the end plates each containing two large bores and one small bore, the large bores being located near the external edge and equidistant from the midline of the width of the end plate, the smaller bore being located interiorly with its center in line with the center of one of the large bores;

a pair of similarly configured flappers including a first flapper and a second flapper, each flapper having a generally rectangular configuration with two parallel long edges and two parallel short edges, the short edges being perpendicular to and connecting to the ends of the long edges, the flappers each being slightly wider than 50 percent of the height of the opening and slightly shorter than the width of the opening and having an arcuate ridge along the central portion of each flapper on the long axis midline and ending on each end of each flapper with a formed cylindrical extension rotatably received within the large bores of the housing;

a control assembly having an actuator subassembly comprising a main plate in a generally semi-circular configuration with an exterior edge configured with ridges and indentations bent to form an actuator surface extending through a slot for control by a user, plate also having an outwardly extending pin rotatably received in the small bore, the plate also having an outrigger arm with a fork receiving an edge of the first flapper to slidably contact the edge of the first flapper whereby rotational movement of the main plate and will cause rotational movement of the first flapper, the plate and arm and exterior edge configured to allow the rotation about a course of travel of between 0 and 90 degrees for opening and closing the first flapper; and the control assembly also having a follower subassembly comprising a link having a proximal end and distal end located adjacent to and parallel with the end plate remote from the actuator sub assembly, the proximal end being generally rounded with a hole and with a flapper tab having a hole aligned with the hole at the proximal end and with a rivet through the two holes, the distal end of the follower subassembly having a flapper tab with a hole and a hook-like extension on the link extending through the hole whereby rotation of the first flapper coupled to the control assembly will rotate the second flapper.

2. An air duct comprising:

a face plate having a rectilinear configuration with an internal face and an external face, the face plate having a rectangular, central opening with a height and a width less than the lengths of the edges to form a solid periphery of between about 1.0 and 2.0 inches around the edges of the faceplate, the central opening having a series of air directing grates such that there are created a plurality of rectangular shaped slots;

a rectilinear housing comprising two parallel long side walls and two parallel short end walls, the walls being oriented perpendicular to the internal face, with the walls having external edges coupled to the interior face of the face plate adjacent to the opening, the end plates each containing two large bores and one small bore;

a pair of similarly configured flappers including a first flapper and a second flapper, each flapper having a generally rectangular configuration, each flapper being slightly wider than 50 percent of the height of the opening and slightly shorter than the width of the opening and having a formed cylindrical extension rotatably received within the large bores of the housing;

a control assembly having an actuator subassembly comprising a main plate in a generally semi-circular configuration with an exterior edge extending through a slot, the plate also having an outwardly extending pin rotatably received in the small bore, the plate also having an outrigger arm bent inwardly to slidably contact an edge of the first flapper whereby rotational movement of the main plate and arm will cause rotational movement of the first flapper; and the control assembly, also having a follower subassembly comprising a link whereby rotation of the flapper coupled to the control assembly will rotate the other flapper.

3. An air duct register system as in claim 2 wherein the exterior edge extends for about 90 degrees.

4. An air duct register system as in claim 2, wherein the exterior edge extends for about 180 degrees and the plate has an undercut region.

* * * * *